US010206053B1

(12) United States Patent
Welti

(10) Patent No.: US 10,206,053 B1
(45) Date of Patent: Feb. 12, 2019

(54) EXTRA-AURAL HEADPHONE DEVICE AND METHOD

(71) Applicant: Harman International Industries, Incorporated, Stamford, CT (US)

(72) Inventor: Todd S. Welti, Thousand Oaks, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/808,474

(22) Filed: Nov. 9, 2017

(51) Int. Cl.
*H04R 5/033* (2006.01)
*H04R 29/00* (2006.01)
*H04S 3/00* (2006.01)

(52) U.S. Cl.
CPC ..... *H04R 29/002* (2013.01); *H04R 5/033* (2013.01); *H04S 3/004* (2013.01); *H04S 2420/01* (2013.01)

(58) Field of Classification Search
None
See application file for complete search history.

(56) References Cited

U.S. PATENT DOCUMENTS 1,087,704 A * 2/1914 Adams-Randall ... H04R 5/0335 381/378
5,684,879 A * 11/1997 Verdick ..... H04R 1/1075 381/300
5,696,831 A * 12/1997 Inanaga ..... H04S 1/007 381/309
8,443,467 B2 * 5/2013 Chiang ..... A61F 11/06 2/209
2001/0031062 A1 * 10/2001 Terai ..... H04R 5/033 381/370
2015/0189422 A1 * 7/2015 Nakano ..... H04R 1/105 381/378
2015/0280677 A1 * 10/2015 Hui ..... H03G 7/007 381/57
2017/0245081 A1 * 8/2017 Lyren ..... H04S 1/005

OTHER PUBLICATIONS

"Old Champ: The AKG K1000," https://www.headfonia.com/old-champ-the-akg-k1000/, published online Mar. 1, 2012; accessed Nov. 9, 2017; 12 pages.

* cited by examiner

*Primary Examiner* — James Mooney
(74) *Attorney, Agent, or Firm* — Brooks Kushman P.C.

(57) ABSTRACT

Headphones are provided with a pair of speakers adapted to be suspended a distance away from the listener's ears and movable between a plurality of test positions. At least one microphone is adapted to be positioned near one of the listener's ears. A controller is in communication with the pair of speakers. The controller is programmed to activate the pair of speakers to produce a test sound at a plurality of test positions. The controller receives playback signals from the microphone based on each of the test sounds at the plurality of test positions. A head related transfer function (HRTF) is determined based on the playback signals received by the microphones.

20 Claims, 2 Drawing Sheets

EXTRA-AURAL HEADPHONE DEVICE AND METHOD

TECHNICAL FIELD

The present disclosure generally relates to audio headphones.

BACKGROUND

Headphones typically seal around the ear or are physically inserted into the ear canal, forming a tight seal to reduce external noise and position acoustic drivers at a close proximity to the ear. While headphones allow a single user to listen to an audio source and provide excellent isolation from outside noise, the headphone may make the user unaware of their surroundings. Further, the listening experience for users with headphones may be unnatural so that the sound appears between the ears or inside a listener's head.

SUMMARY

According to at least one embodiment, headphones are provided with a pair of speakers adapted to be suspended a distance away from the listener's ears and movable between a plurality of test positions. At least one microphone is adapted to be positioned near one of the listener's ears. A controller is in communication with the pair of speakers. The controller is programmed to activate the pair of speakers to produce a test sound at a plurality of test positions. The controller receives playback signals from the microphone based on each of the test sounds at the plurality of test positions. A head related transfer function (HRTF) is determined based on the playback signals received by the microphones.

In another embodiment, the headphones have a headband and a pair of movable struts. Each of the pair of moveable struts is attached to the headband at a proximal end holds one of the pair of speakers at a distal end.

In another embodiment, each of the pair of moveable struts are extendable to vary the distance each of the speakers is suspended away from the headband.

In another embodiment, the headphones have a rotation hub positioned along a central portion of the headband. The pair of movable struts are connected to rotate about the rotation hub.

In another embodiment, the rotation hub has a servo. The servo automatically moves the movable struts between the plurality of test positions.

In another embodiment, the controller is programmed to command the servo to move the pair of speakers to the plurality of test positions.

In another embodiment, the controller is programmed to command the pair of speakers to move to a listening position. The controller is programmed to apply an audio filter to an audio output of the each of the speakers based on the HRTF thereby generating directional sound output different from a listening position direction at each of the speakers.

In another embodiment, the controller is programmed to determine an optimum listening position based on the playback signals. The controller commands the speakers to move to the optimum listening position.

In another embodiment, the controller is programmed to determine a crosstalk cancellation factor for each of the pair of speakers.

According to at least one other embodiment, extra-aural headphones are provided with a headband and a pair of acoustic drivers connected to the headband. The acoustic drivers are adapted to be suspended a distance away from a listener's ears and movable between a plurality of test positions. At least one microphone is adapted to be positioned adjacent one of the listener's ears. A user-specific head related transfer function (HRTF) is determined based on the signals received by the microphone when the acoustic drivers are driven at each of the plurality of test positions.

In another embodiment, the headphones have a pair of microphones connected to the headband. One of the pair of microphones is adapted to be positioned within each of the listener's ears.

In another embodiment, the headphones have a rotation hub positioned along the headband. The pair of acoustic drivers are rotatable about the rotation hub to a plurality of test angles relative to the listener's ears.

In another embodiment, the headphones have a pair of movable struts are connected to rotate about the rotation hub and connected to the pair of acoustic drivers. The rotation hub includes a plurality of locking features. The pair of moveable struts are adapted to engage one of the plurality of locking features to move the movable struts between the plurality of test positions.

In another embodiment, the headphones have a pair of movable struts are connected to rotate about the rotation hub and connected to the pair of acoustic drivers. The rotation hub comprises a motor connected to the headband and the pair of movable struts. The motor automatically moves the movable struts between the plurality of test positions.

According to at least one embodiment, a method is provided. The method includes providing a headset having a pair of speakers and at least one microphone adapted to be position near a user's ears. The pair of speakers is moved to a plurality of test positions each a distance spaced away from the user's ears. A playback test signal is measured from the pair of speakers at each of the plurality of test positions with the microphone. A head related transfer function (HRTF) is determined based on the playback test signals measured by the pair of microphones.

In another embodiment, the method includes commanding the pair of speakers to move to the plurality of test positions.

In another embodiment, the method includes commanding the pair of speakers to move to a listening position after the pair of speakers are moved to each of the plurality of test positions.

In another embodiment, the method includes determining a left HRTF for a left speaker of the pair of speakers and determining a right HRTF for a right speaker of the pair of speakers.

In another embodiment, the method includes determining a crosstalk cancellation factor for each of the left speaker and the right speaker.

In another embodiment, the method includes determining an optimum listening position based on the playback test signals. The speakers are commanded to move to the optimum listening position.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
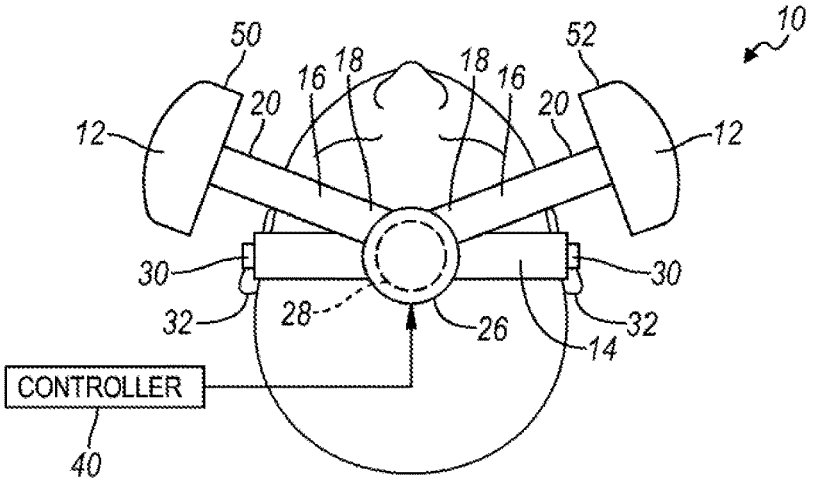
FIG. 1 illustrates a schematic top view of an extra-aural headphone assembly according to one embodiment.

FIG. 1 illustrates an extra-aural headphone assembly 10 having speakers, or acoustic drivers 12 for generating soundwaves. Typical headphone styles usually include one of three types, all having earpieces that contact the user's head or ear. For example, supra-aural headphones are positioned on top of a user's ears, circum-aural headphones surround a user's ears, or intra-aural headphones are positioned within the user's ear. However, there are drawbacks for the listener when multi-channel or stereo sound is reproduced over these typical headphones. Stereo recordings are usually meant to be reproduced over loudspeakers, such as 5.1 and 7.1 surround sound systems, or even two-channel stereo systems, instead of being played back over headphones. When stereo recordings are reproduced in typical headphones, the results in the stereo panorama appearing on line in between the ears or inside a listener's head can be an unnatural and fatiguing listening experience.

Unlike these typical headphone assemblies, the extra-aural headphone assembly 10 allows the sound to seem like directional stereo surround sound. The extra-aural headphone assembly 10 positions the acoustic drivers 12 at a distance spaced away from the user's ears and do not contact the user's head. Audio signals are provided to the extra-aural headphone assembly 10, which are used to drive the acoustic drivers 12 to provide audible sound to the user.

The extra-aural headphone assembly 10 includes a headband 14 for securing the extra-aural headphone assembly to the user's head. Movable struts 16 are attached to the headband 14 and the acoustic drive and allow the acoustic driver to be positioned at various locations relative to the user's head. Each movable strut 16 is connected to the headband 14 at a proximal end 18 and holds one of the pair of acoustic drivers 12 at a distal end 20. In addition, the struts 16 may be extendable to vary a length of the struts 16, thereby varying the lateral distance each of the acoustic drivers 12 is suspended away from the headband. By extending the length of the struts 16, the extra-aural headphone assembly 10 can be further sized for the user's specific head dimensions. In one embodiment, the acoustic drivers 12 may be suspended eight to sixteen inches away from the user's ears. However, the acoustic drivers 12 may be spaced away from the user's ears a farther distance. In another embodiment, the acoustic drivers 12 may be spaced away from the user's ears by five to nine inches. In yet another embodiment, the acoustic drivers may be suspended away from the user's ears by two to five inches.

The extra-aural headphone assembly 10 also includes a rotation hub 26 positioned along a central portion of the headband 14, such as along the crown of the user's head. The movable struts 16 are connected at the proximal end 18 to rotate about the rotation hub 26. The rotation hub 26 may also include a motor 28 for controlling rotation of the movable struts. For example, the motor 28 may be a servomotor or other small motor that can be attached to the headband 14 and is lightweight. The motor 28 is adapted to automatically move the movable struts 16 between the plurality of test positions. The extra-aural headphone assembly 10 may also include a plurality of locking features that allow the struts to be moved manually by the user. The locking features may be detents or notches that correspond to each of the test positions.

At least one microphone 30 is also provided with the extra-aural headphone assembly 10. As shown in FIG. 1, the extra-aural headphone assembly 10 includes a pair of microphones 30. The pair of microphones 30 are adapted to be positioned near or in the opening of the listener's left and right ear canals 32. The microphones 30 may be connected to lower ends of the headband 14 to be positioned at or in the user's ear canals. The microphones 30 may be used to determine the user-specific head related transfer function (HRTF), as discussed below, and after such use would be able to disconnect from the headphone assembly 10 for storage.

In another embodiment, each microphone 30 may include a plurality of microphones or microphone array, such as a front microphone and a rear microphone. The microphones 30 may be omnidirectional, though other types of directional microphones having different polar patters may be used such as unidirectional or bidirectional microphones. These microphones would be placed at various locations in and around the pinna, to avoid that such microphones need to be placed in the ear canal, which may be uncomfortable for some users.

The extra-aural headphone assembly 10 may also have a controller 40 that is in communication with the pair of acoustic drivers 12 and microphones for determining the user-specific HRTF. The controller 40 may be a microcontroller integrated in the extra-aural headphone assembly 10 or the control system may be implemented as or incorporated into various devices, such as a personal computer (PC), a tablet PC, a personal digital assistant (PDA), a mobile device, a palmtop computer, a laptop computer, a desktop computer, a communications device, a wireless telephone, an audio device, or any other machine capable of executing a set of instructions (sequential or otherwise) that specify actions to be taken by that machine.

The headphone assembly 10 and controller 40 may include additional control modules. The term "module" may be defined to include a plurality of executable modules. As described herein, the modules are defined to include software, hardware or some combination of hardware and software that is executable by a processor. Software modules may include instructions stored in memory that are executable by the processor or another processor. Hardware modules may include various devices, components, circuits, gates, circuit boards, and the like that are executable, directed, and/or controlled for performance by the processor.

For example, the headphone assembly 10 and controller 40 may include an analog-to-digital converter (ADC) associated with each microphone 30 to convert analog audio signals to digital format. The controller may further include a digital signal processor (DSP) for processing the digitized microphone signals and providing output signals to the acoustic drivers 12. Accordingly, the extra-aural headphone assembly 10 may further include a digital-to-analog converter DAC and/or speaker driver (not shown) associated with each acoustic driver 12. Further, while a single controller is illustrated, the controller may include any collection of control modules that individually or jointly execute a set, or multiple sets, of instructions to perform one or more computer or control functions, for example.

In addition, the extra-aural headphone assembly 10 is in communication with an audio device or electronic audio source providing audio input signals. The extra-aural headphone assembly 10 may include a wire and adaptor (not shown) connectable to the electronic audio source for receiving audio signals therefrom. Examples of audio devices include an amplifier, a compact disc player, a television, a vehicle head unit, a radio, a home theater system, an audio receiver, an MP3 player, an audio headphone, a phone, or any other device capable of generating audio signals and/or audible sound perceived by a listener. In a particular example, the extra-aural headphone assembly 10 may be in communication using a wireless electronic device, such as a smartphone, that provides voice, audio, video or data communication.

The extra-aural headphone assembly 10 may include a left speaker 50 and a right speaker 52 for generating the sound waves in response to incoming audio signals. For instance, the left speaker 50 may receive a left headphone output signal (LH) from the DSP and the right speaker 52 may receive a right headphone output signal (RH) from the DSP. Accordingly, the extra-aural headphone assembly 10 may further include a digital-to-analog converter DAC and/or speaker driver (not shown) associated with each speaker 50, 52.

Figure 2:
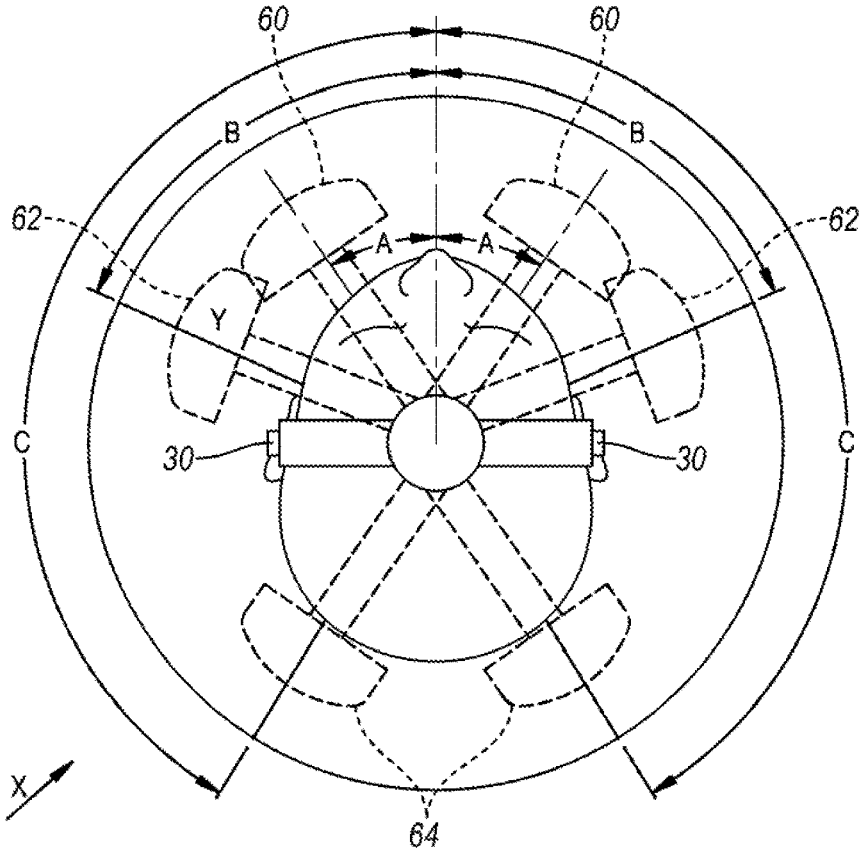
FIG. 2 illustrates the extra-aural headphone assembly of FIG. 1 and the acoustic transducers at a plurality of positions.
Figure 3:
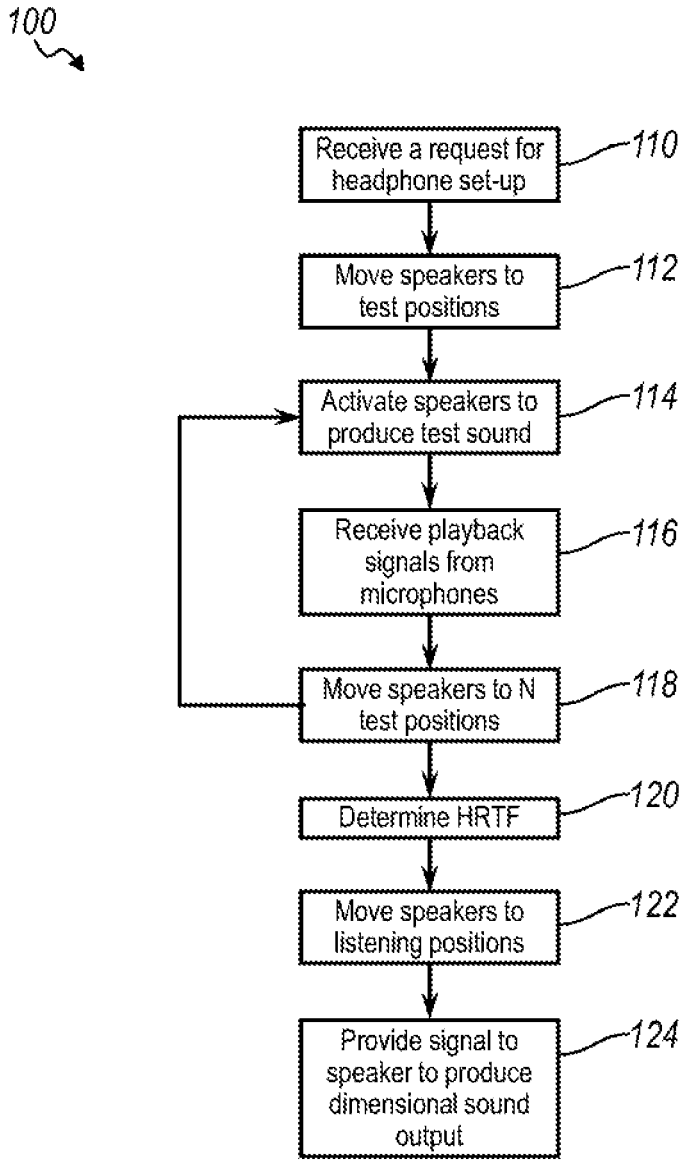
FIG. 3 is a flowchart illustrating a method of using the extra-aural headphone assembly of FIG. 1.

As shown in FIG. 2 and to FIG. 3, the extra-aural headphone assembly 10 may be used to determine a head-related transfer function (HRTF) that is user-specific for the listener wearing the extra-aural headphone assembly 10. A HRTF is a response that characterizes how an ear receives a sound from a point in space. A pair of HRTFs for two ears can be used to synthesize a binaural sound that seems to come from a particular point in space. For instance, the HRTFs may be designed to render sound sources in front of the listener (e.g., at ±30 degrees or ±45 degrees relative to the listener).

Existing test methods and apparatus for measuring audio signals generated by headphones often include standard ear simulators in accordance with IEC 60711 (for example GRAS 43AG). The resulting response from these test methods and apparatus is claimed to resemble the sound pressure at the ear drum of an "average" person. However, actual physical variations between users, such as the size of the user's head, distance between the user's ears, and the contour of the ear (i.e., the pinna and the ear canal) can significantly affect the perceived sound of a headphone. Therefore, measurement data of an average user does not take into account individually perceived frequency responses and variations among listeners.

FIG. 2 illustrates the speakers 50, 52 at various test locations relative to the user's head and the headband 14. The test locations may be examples of loudspeaker configurations that would be emulated by the HRTF's generated using the extra-aural headphone assembly 10 according to the present disclosure. Each of the left and right speakers 50, 52 may include one or more acoustic transducers 12. In one embodiment shown in FIG. 2, the speakers 50, 52 are located at test positions based on standard angles that are used for measurement and playback for surround sounds, such as standard ITU-R BS 775. For example, at a first test position 60, the speakers are oriented forward of the user's ears and the left and right speakers 50, 52 are moved from the direct forward position by an angle A. In one embodiment, angle A is approximately 30-degrees. In a second test position 62, the speakers are oriented forward of the user's ears and the left and right speakers 50, 52 are moved from the direct forward position by an angle B, greater than angle A. In one embodiment, angle B is approximately 60-degrees. A third test position 64 orients the speakers 50, 52 rearwards of the user's ears at an angle C from the direct forward position. In one embodiment, angle C is approximately 150-degrees. In another testing configuration, angle A may be 0-degrees, or directly forward, angle B may be approximately 30-degrees, and angle C may be approximately 110-degrees. Of course, the number and angle of test positions may vary based on the requirements and suitable test for defining stereo surround sound based on the input source, or other listening factors.

FIG. 3, the flowchart describes a method 100. The extra-aural headphone assembly 10 and method 100 allow the HRTF to be generated for a specific listener. The process 100 begins at block 110 where the controller receives a request to set-up a headphone assembly for a specific user. The extra-aural headphone assembly 10 or audio input device may provide an input for the user to request the set-up procedure. Alternatively, the request may be provided anytime the extra-aural headphone assembly is put on the head of a user or when the headphone assembly detects a new user, for example.

At block 112, the controller 40 may command the speakers 50, 52 to move to a test position. In order to move the speakers 50, 52, the controller 40 may command the motor 28 to move the struts 16 thereby moving the speakers 50, 52 to the plurality of test positions, for example 60, 62, 64. In another embodiment, the extra aural headphone assembly 10 may also provide the user instructions for manually moving the struts 16 and speakers 50, 52 to pre-set test positions.

At block 114, the controller commands the acoustic drivers 12 in each of the left and right speakers 50, 52 to produce a stimulus.

At block 116 the controller receives test signals from the microphones 30 based on each of the test stimuli.

After the first test position, the controller 40 may move, or command the speakers 50, 52 to move to the other test positions, at block 118. The test positions may include at least one forward position and one rearward test position. The number and location of the test positions may vary based on specific application requirements. At each test position, the controller activates the acoustic drivers 12, at block 114 and receives playback signals from the microphones 30, at block 116. The motor 28 may automatically move the struts 16 and speakers 50, 52 to the plurality of test positions 60, 62, 64 without further input from the user between test positions.

After the speakers 50, 52 have been moved to the plurality of test positions, the controller determines a head related transfer function (HRTF) based on the playback signals received by the microphones, at block 120. The controller may determine a separate HRTF for the left speaker 50 and the right speaker 52. This determination may include a correction factor to account for the difference of near field HRTF measurement versus the desired far field HRTF.

Once the testing is completed, the speakers 50, 52 can be moved to the listening position, at block 122. The listening position for extra-aural headphones may position the headphone slightly forward of the user's ear at a pre-set position. The controller may also determine the optimal listening position for a specific user which may be the best playback angle for the extra-aural headphones to provide surround sound, or producing an HRTF with minimal error. The controller 40 may command the motor 28 to move the struts and speakers 50, 52 to the optimum listening position.

At block 124 the controller provides signals to the speakers 50, 52 using filters derived from all the measurements and HRTF so that sounds from all lateral directions can be emulated by the speakers at one fixed position and fully individualized for each user. For example, in simplified from, the filter for synthesizing sound arriving from direction X using headphone playback at position Y for the left speaker 50 directed to the user's left ear is:

$$\frac{H_{X\ to\ Left\ Ear}}{H_{Y\ to\ Left\ Ear}}$$

So that when played back over the headphone at position Y, the result is:

$$\frac{H_{X\ to\ Left\ Ear}}{H_{Y\ to\ Left\ Ear}} * H_{Y\ to\ Left\ Ear} = H_{X\ to\ Left\ Ear} \approx \text{source at same direction as } H_X$$

Various flavors of up-mixing could be also used to generate directional effects and envelopment from a stereo or discrete source material.

As an enhancement to the technique, the correction factor determined separately for each of the left and right speakers, may be enhanced and optimized by including additional correction factors to the other speaker. The additional correction factor may include crosstalk cancellation, where an appropriate signal is added to the right speaker to prevent the right speaker from disrupting the correction calculated for the left speaker and left ear (and vice versa).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. Headphones comprising:

a headband;

a pair of speakers connected to the headband and adapted to be suspended a distance away from a listener's ears, each speaker movable forward and rearward of the headband and adapted to be moveable forward and rearward of the listener's ears between a plurality of test positions;

at least one microphone adapted to be positioned near one of the listener's ears; and a controller in communication with the pair of speakers and programmed to:

activate the pair of speakers to produce a test sound at each of the plurality of test positions;

receive playback signals from the microphone based on each of the test sounds at the plurality of test positions;

determine a head related transfer function (HRTF) based on the playback signals received by the at least one microphone.

2. The headphones of claim 1, further comprising:

a pair of movable struts, each of the pair of moveable struts attached to the headband at a proximal end and holding one of the pair of speakers at a distal end.

3. The headphones of claim 2, wherein each of the pair of moveable struts are extendable to vary the distance each of the speakers is suspended away from the listener's ears.

4. The headphones of claim 2 further comprising a rotation hub positioned along a central portion of the headband, wherein the pair of movable struts are connected to rotate about the rotation hub.

5. The headphones of claim 4, wherein the rotation hub further comprises a servo, the servo automatically moving the movable struts between the plurality of test positions.

6. The headphones of claim 5, wherein the controller is further programmed to command the servo to move the pair of speakers to the plurality of test positions.

7. The headphones of claim 1, wherein the controller is further programmed to:

command the pair of speakers to move to a listening position; and apply an audio filter to an audio output of the each of the speakers based on the HRTF thereby generating directional sound output different from the listening position direction at each of the speakers.

8. The headphones of claim 1, wherein the controller is further programmed to:

determine an optimum listening position based on the playback signals; and command the speakers to move to the optimum listening position.

9. The headphones of claim 1, wherein the controller is further programmed to determine a crosstalk cancellation factor for each of the pair of speakers.

10. Extra-aural headphones comprising:

a headband;

a pair of acoustic drivers connected to the headband and adapted to be suspended a distance away from a listener's ears, each of the acoustic drivers rotatable relative to the headband and adapted to be moveable forward and rearward of the listener's ears between a plurality of test positions; and at least one microphone adapted to be positioned adjacent one of the listener's ears, wherein a user-specific head related transfer function (HRTF) is determined based on the signals received by the microphone when the acoustic drivers are driven at each of the plurality of test positions.

11. The extra-aural headphones of claim 10, wherein the at least one microphone comprises a pair of microphones connected to the headband and, one of the pair of microphones adapted to be positioned within each of the listener's ears.

12. The extra-aural headphones of claim 10, further comprising a rotation hub positioned along the headband, wherein the pair of acoustic drivers are rotatable about the rotation hub to a plurality of test angles relative to the listener's ears.

13. The extra-aural headphones of claim 12, further comprising a pair of movable struts that are connected to rotate about the rotation hub and connected to the pair of acoustic drivers, wherein the rotation hub includes a plurality of locking features, and the pair of moveable struts are adapted to engage one of the plurality of locking features to move the movable struts between the plurality of test positions.

14. The extra-aural headphones of claim 12, further comprising a pair of movable struts that are connected to rotate about the rotation hub and connected to the pair of acoustic drivers, wherein the rotation hub comprises a motor connected to the headband and the pair of movable struts, the motor automatically moving the movable struts between the plurality of test positions.

15. A method comprising:

providing a headset having a pair of extra-aural speakers moveable relative to a headband and adapted to be suspended a distance away from a listener's ears and the headset having at least one microphone adapted to be position near the listener's ears;

moving each of the pair of speakers forward and rearward relative to the headband to a plurality of test positions;

measuring a playback test signal from the pair of speakers at each of the plurality of test positions with the microphone; and determining a head related transfer function (HRTF) based on the playback test signals measured by the pair of microphones.

16. The method of claim 15 further comprising:

commanding the pair of speakers, by a controller, to move to the plurality of test positions when a new user is detected.

17. The method of claim 15 further comprising:

commanding the pair of speakers, by a controller, to move to a listening position after the pair of speakers are moved to each of the plurality of test positions.

18. The method of claim 17 wherein determining the HRTF comprises:

determining a left HRTF for a left speaker of the pair of speakers; and determining a right HRTF for a right speaker of the pair of speakers.

19. The method of claim 18 further comprising:

determining a crosstalk cancellation factor for each of the left speaker and the right speaker.

20. The method of claim 15 further comprising:

determining an optimum listening position based on the playback test signals; and commanding the pair of speakers, by a controller, to move to the optimum listening position.

* * * * *